United States Patent [19]

Thorley

[11] Patent Number: 4,685,697

[45] Date of Patent: Aug. 11, 1987

[54] RETRACTABLE SKI LEASH DEVICE EMBODYING DUAL PURPOSE LOCKING MEANS

[76] Inventor: Neil R. Thorley, 5236 N. 73rd Pl., Paradise Valley, Ariz. 85253

[21] Appl. No.: 906,131

[22] Filed: Sep. 11, 1986

[51] Int. Cl.[4] ..... A63C 11/02

[52] U.S. Cl. ..... 280/637; 70/58; 280/814

[58] Field of Search ..... 280/637, 814, 815; 70/58

[56] References Cited

U.S. PATENT DOCUMENTS

| | | | |
|---|---|---|---|
| 3,714,803 | 2/1973 | Chenenko | 280/814 |
| 3,764,154 | 10/1973 | Witting | 280/637 |
| 3,826,510 | 7/1974 | Halter | 280/637 |
| 3,893,682 | 7/1975 | Weinstein et al. | 280/637 |
| 3,905,214 | 9/1975 | Bell | 70/58 |
| 3,941,397 | 3/1976 | Kidder et al. | 280/637 |
| 4,203,614 | 5/1980 | Marker | 280/637 |
| 4,231,586 | 11/1980 | Krause | 280/637 |

FOREIGN PATENT DOCUMENTS

| | | | |
|---|---|---|---|
| 2406754 | 8/1975 | Fed. Rep. of Germany | 280/637 |
| 2624501 | 12/1977 | Fed. Rep. of Germany | 280/637 |
| 2706015 | 8/1978 | Fed. Rep. of Germany | 280/637 |
| 2930502 | 2/1981 | Fed. Rep. of Germany | 280/637 |
| 3133240 | 3/1983 | Fed. Rep. of Germany | 280/637 |

*Primary Examiner*—David M. Mitchell

*Attorney, Agent, or Firm*—Warren F. B. Lindsley

[57] ABSTRACT

A retractable ski leash device for mounting on a ski employing a dual purpose lock wherein the lock comprises a clasp attached to the end of the leash for surrounding the boot of the skier and clamping back on the line and when the ski is not in use, may be used for surrounding a post, rack or the like, and then engaged with the housing of the device for locking the clasp to the housing.

6 Claims, 6 Drawing Figures

FIG. 1
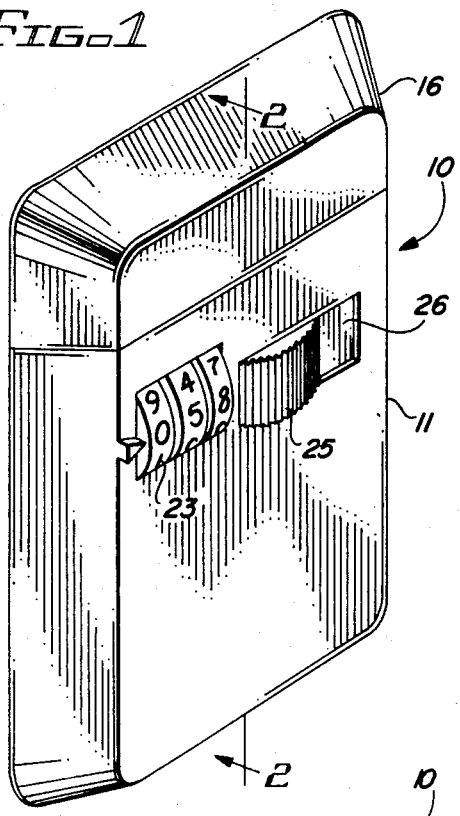
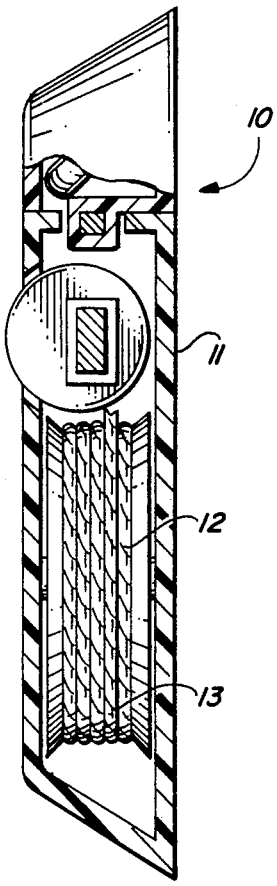
FIG. 4
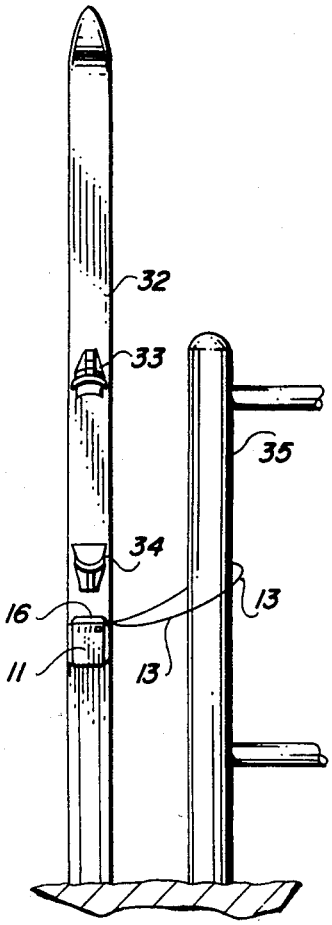
FIG. 5
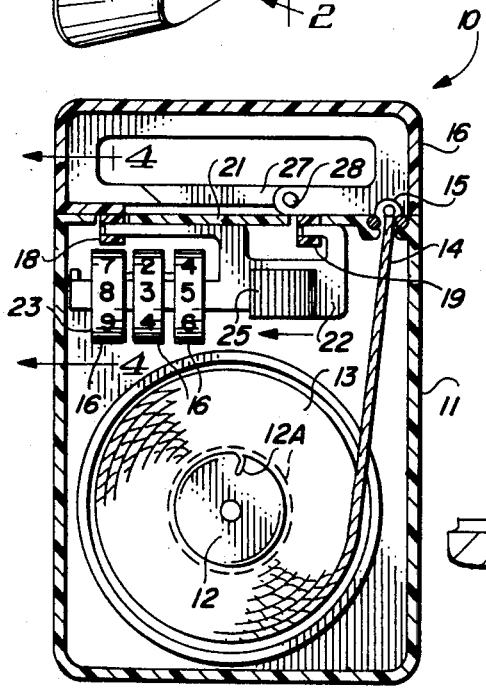
FIG. 2
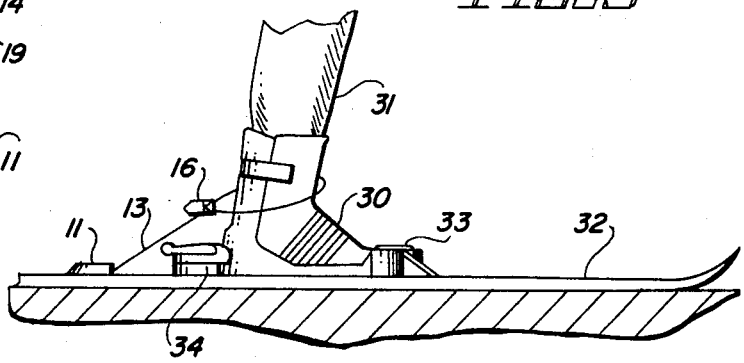
FIG. 6
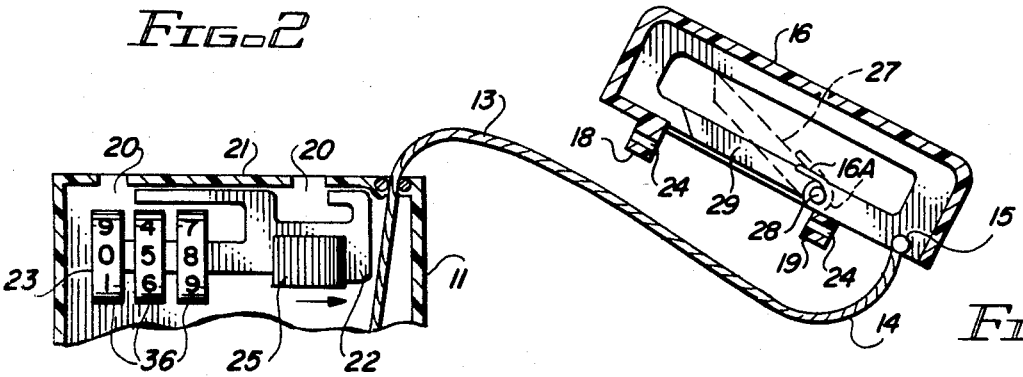
FIG. 3

RETRACTABLE SKI LEASH DEVICE EMBODYING DUAL PURPOSE LOCKING MEANS

BACKGROUND OF THE INVENTION

This invention relates to a retractable leash or lanyard interconnecting a ski and ski boot for retrieving a loose ski and more particularly to such a ski mounted device employing a dual purpose locking means, the clasp of which is used for attaching one end of the leash to the user's boot and/or for locking the ski to a relatively stationary structure when the ski is not in use.

PRIOR ART

Various devices have been developed to aid a skier in retrieving a loose ski, but none have combined a ski retrieving means with a locking means for not only attaching a retrieving means to a ski and skier, but also locking a ski to a relatively stationary means such as a post, rack or other storage means when the ski is not in use.

U.S. Pat. No. 3,764,154 discloses a safety ski binding which includes rigid base plate member disposable between a sole member of a ski boot and a ski member. A pair of locking devices are inserted in the sole, base plate or the ski to protect them from the affects of snow, ice or dirt.

U.S. Pat. No. 3,893,682 discloses a releasable safety ski binding having a self-restoring capability. The binding includes a soleplate detachably connected to the ski boot and operatively coupled to the ski by heel and toe connecting units carried by the soleplate and an associated pair of mounting elements secured to the ski.

U.S. Pat. No. 4,203,614 discloses a ski binding employing a cable connected at one end to the skiing boot and at the other end to the ski. The skiing boot is detachably held on a binding plate by means of a forward soleholder and a rear soleholder. The underside of the binding plate is releasably locked to the ski approximately on the axis of the tibia of the skier by a detent mechanism which comprises a one-base segment of an ellipsoid and a mating cap.

German Pat. No. 24 06 754 discloses a retractable line tethering a ski to a skier's boot.

German Pat. No. 26 24 501 discloses a strap having one end fastened to the heel housing of the ski boot via a coil spring. A snap hook on the other end is attached to an eye on the ski or ski binding.

German Pat. No. 27 06 015 discloses a ski recovery device consisting of a belt which is attached to the ski boot or ankle of the user at one end, and fixed to the ski at the other end. In the event of a fall in which the ski slides downhill, the belt is wound up again automatically returning the ski.

German Pat. No. 29 30 502 discloses a rotatable spool fitted on the upper surface of a ski which carries a connecting line to be attached to the skier. The connecting line is made from a phosphorescent material and employs an optical or acoustic warning installation on the ski and coordinated with the moving of the spool.

SUMMARY OF THE INVENTION

In accordance with the invention claimed, a new and improved retractable ski leash device employing a dual purpose locking means is provided. The locking means employs an attachment means which is utilized for attaching the end of the leash to the boot or leg of the user, and when the ski is not in use may be used to attach and lock the ski to a rack or bench.

It is, therefore, one object of this invention to provide a new and improved retractable ski leash tethering device employing a dual purpose locking means.

Another object of this invention is to provide a new and improved retractable ski leash tethering device that employs a combination locking means.

A further object of this invention is to provide a device employing a locking means having a clasp mounted on one end of a retractable line tethered at the other end to a ski mounted housing which clasp grasps the line when encircling the ski boot of the user and when the ski is not in use, interlocks with the housing to form a combination locking device.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described with reference to the accompanying drawing in which:

FIG. 1 is a perspective view of a retractable ski line tether device embodying the invention;

FIG. 2 is a cross-sectional view of FIG. 1 taken along the line 2—2;

FIG. 3 is a partial view of FIG. 2 with a clasp of a combination lock mounted on one end of a leash removed from the housing of the device;

FIG. 4 is a cross-sectional view of FIG. 2 taken along the line 4—4;

FIG. 5 is a prospective view showing the tether device mounted on a ski and the leash wound around a post and the clasp locked to the housing of the device; and FIG. 6 is an illustration of the clasp of the tether device shown in FIGS. 1-4 engaging the leash wound around the ski boot of a user for use in retracting the associated ski if it becomes separated from the foot of the user.

DESCRIPTION OF THE PREFERRED EMBODIMENT

Referring more particularly to the drawing by characters of reference, FIGS. 1-4 illustrate a line tethering device 10 comprising a housing 11 having a spool 12 rotatably mounted therein which is biased in a given direction by a spring 12A for retrieving a leash or line 13 wound around the spool. The free end 14 of the line is provided with a head 15 which is captured and anchored within a clasp 16 which may form a detachable part of housing 11.

As shown in FIGS. 2 and 3, clasp 16 may be provided with one or more prongs, but is shown as comprising two spaced apart prongs 18 and 19 which are intended to fit into slots 20 in the top 21 of housing 11 for detachably engaging with a movable bar means 22 of a combination lock 23 mounted in housing 11.

The movable bar means 22 is controlled by a combination lock 23, and in the position shown in FIG. 2 is interlocked with grooves 24 formed in prongs 18 and 19 of clasp 16, and in FIG. 3 is shown in a position disengaged from prongs 18 and 19 of clasp 16. Bar means 24 may be manually reciprocated by means of a knurled knob 25 protruding through an aperture 26 in housing 11 as shown in FIG. 1.

As shown more clearly in FIG. 3, clasp 16 comprising an elongated hollow member completing the top of the geometrical shape of housing 11, is provided with a latch 27 pivotally mounted at 28 for moving through an opening 29 into the hollow interior of clasp 16 and biased by a spring 16A to normally close opening 29.

Opening 29 provides a way for line 13 to be moved into the clasp in the manner shown in FIG. 6 to detachably engage and connect the clasp end of line 13 around boot 30 of a skier 31 secured to a ski 32. Boot 30 is attached to ski 32 in a well known manner by means of the toe and heel attachment means 33 and 34.

FIG. 5 illustrates a means of using the line tethering device 10 to lock ski 32 to a post 35. In this instance, the clasp end of line 13, when the clasp is disengaged from housing 11, is circled around post 35, as shown, and then the prongs of clasp 16 are inserted through openings 20 in the top 21 of housing 11. The movable bar means 22 is then moved to left as shown in FIG. 2 to engage grooves 24 in prongs 18 and 19 with the combination lock being properly dialed to its required numbers for releasing bar means 22. With the bar means in place as shown in FIG. 2, the combination lock numbered discs 36 are then moved to lock the bar means in place and the ski is tethered and locked to post 35.

To release line 13 from around post 35, discs 36 are rotated to 0-5-8, as shown in FIG. 3, to open the lock and release bar means 22 for moving to the right as shown by the arrow in FIG. 3.

Although but a single embodiment of the present invention has been illustrated and described, it will be apparent to those skilled in the art that various changes and modifications may be made therein without departing from the spirit of the invention or from the scope of the appended claims.

What is claimed is:

1. A dual purpose ski recovery and locking device comprising:

a housing, a clasp detachably mounted on said housing, a spring biased retractable spool journalled in said housing, a line fastened at one end to said spool and wound therearound with the free end thereof exposed on the periphery of said spool, a locking means mounted in said housing for engaging and releasing said clasp from said housing, and means for attaching the free end of said line to said clasp, said clasp having latch means for engaging said line when said clasp is disengaged from said housing and at least one prong for engaging and interlocking with said locking means in said housing when mounted on said housing.

2. The dual purpose ski recovery and locking device set forth in claim 1 wherein:

said clasp comprises a pair of spaced prongs for engaging and interlocking with said locking means.

3. The dual purpose ski recovery and locking device set forth in claim 1 wherein:

said locking means comprises a combination lock.

4. The dual purpose ski recovery and locking device set forth in claim 1 wherein:

said clasp comprises an elongated hollow member for fitting over one end of said housing with said prong extending into said one end of said housing, and said latch means comprises a spring biased pivotally movable latch for closing a line receiving opening in said clasp.

5. The dual purpose ski recovery and locking device set forth in claim 3 wherein:

said locking means comprises a reciprocably movable bar means mounted in said housing, said bar means interlocking with said clasp in a locking position and disengaging from said clasp in an unlocked position, and hand operated actuating means mounted on said housing for moving said bar means to said locking and unlocking positions.

6. A dual purpose ski recovery and locking device comprising:

a housing, a clasp detachably mounted on one end of said housing, a spring biased retractable spool journalled in said housing, a line fastened at one end to said spool and wound therearound with the free end thereof exposed on the periphery of said spool, a combination lock mounted in said housing for engaging and releasing said clasp from said housing, said lock comprising a reciprocally movable bar means mounted in said housing, said bar means interlocking with said clasp in a locking position and disengaging from said clasp in an unlocked position, a hand operated means mounted on said housing for moving said bar means to said locked and unlocked positions, and means for attaching the free end of said line to said clasp, said clasp having latch means for engaging said line when said clasp is disengaged from said housing and at least one prong for engaging and interlocking with said locking means when mounted on said housing.

* * * * *